US005800628A

United States Patent [19]

Erickson et al.

[11] Patent Number: 5,800,628

[45] Date of Patent: Sep. 1, 1998

[54] CONTINUOUS CYCLE OPERATION FOR DISHWASHERS USING TURBIDITY SENSOR FEEDBACK

[75] Inventors: Timothy K. Erickson, Lena; Gary R. O'Brien, Freeport, both of Ill.

[73] Assignee: Honeywell Inc., Minneapolis, Minn.

[21] Appl. No.: 734,937

[22] Filed: Oct. 22, 1996

[51] Int. Cl.[6] ..... B08B 3/02

[52] U.S. Cl. ..... 134/18; 68/12.02; 134/25.2; 134/57 D; 134/56 D; 134/58 D

[58] Field of Search ..... 134/18, 21, 25.1, 134/25.2, 56 R, 57 R, 57 D, 56 D, 58 R, 58 D; 68/12.02

[56] References Cited

U.S. PATENT DOCUMENTS

| | | | |
|---|---|---|---|
| 4,673,441 | 6/1987 | Mayers | 134/25.2 |
| 4,810,306 | 3/1989 | Noren | 134/25.2 |
| 5,223,042 | 6/1993 | Milocco | 134/25.2 |
| 5,291,626 | 3/1994 | Molnar et al. . | |
| 5,331,177 | 7/1994 | Kubisiak et al. . | |
| 5,429,679 | 7/1995 | Young, Jr. | 134/25.2 |
| 5,444,531 | 8/1995 | Foreman et al. . | |
| 5,446,531 | 8/1995 | Boyer et al. . | |
| 5,545,259 | 8/1996 | Suzuki et al. | 134/25.2 |
| 5,560,060 | 10/1996 | Dausch et al. | 134/25.2 |
| 5,611,867 | 3/1997 | Cooper et al. | 134/25.2 |

*Primary Examiner*—Jan Ludlow

*Attorney, Agent, or Firm*—William D. Lanyi; Roland W. Norris

[57] ABSTRACT

A method for washing objects automatically provides the taking of turbidity measurements before and after a portion of water is removed from the dishwasher. This partial drain allows first and second magnitudes of turbidity characteristics, taken before and after the partial drain, to be compared to each other for an analysis of the degree and/or character of particulates within the water of a dishwasher. In certain applications of this method, the turbidity characteristics can be the absolute magnitude of turbidity, the rate of change of turbidity, the absolute magnitude of turbidity variability and the rate of change of the absolute magnitude of turbidity variability. The portion of water removed between the two sets of readings that yield the first and second magnitudes of the selected characteristics is less than the total amount of water within the dishwasher.

20 Claims, 11 Drawing Sheets

CONTINUOUS CYCLE OPERATION FOR DISHWASHERS USING TURBIDITY SENSOR FEEDBACK

BACKGROUND OF THE INVENTION

1. Field of the Invention

The present invention is generally related to a method for washing an object and, more particularly, a method for washing an object that uses turbidity information in order to modify the washing procedure wherein the turbidity characteristics are analyzed to determine the degree and character of particulates within the water as a function of the difference between two magnitudes of the characteristic of turbidity taken before and after the removal of a first portion of an initial quantity of water from the machine for washing the object.

2. Description of the Prior Art

Automatic dishwashers have been known to those skilled in the art for many years. Most different dishwashers operate in a generally similar manner. For example, dishwashers made for use in the United States typically incorporate a single pump. The pump can be driven in one direction to circulate water and cause the water to be sprayed against the dishes. When driven in an opposite direction, the pump can be used to drain the liquid from the dishwasher. Many dishwashers of this general type incorporate food disposers, or chopper blades, in the drain system to chop larger particulates before pumping them out of the drain conduit. A typical dishwasher made for use in the United States is designed to use an average of approximately seven to twelve quarts of water per fill. The dishwasher is normally designed to incorporate a five fill cycle procedure that includes a prewash, a rinse, a main wash and two final rises. If the machine performs all five of these cycles, sixty quarts of water could be used during the entire dishwashing procedure.

Dishwashers made for use in European markets normally do not comprise food disposers or chopper blades in the drain system. Instead, the filter system is designed to collect large food items which can then be removed by the user. These models of dishwashers typically use an average of three to four quarts of water per fill, but normally provide a five fill cycle procedure in a manner generally similar to dishwashers made for use in the United States. Dishwashers made for use in Europe differ from those made for use in the United States most significantly by their incorporation of individual drain pumps and recirculation pumps. Rather than using a reversing motor for both purposes, they provide a separate drain pump motor that can be used to purge the liquid from the dishwasher and another recirculation pump motor that can be used simultaneously to circulate water and cause the water to move into contact with surfaces of the dishes within the dishwasher. Some dishwashers use a turbidity sensor to monitor the turbidity of the water within the machine.

U.S. Pat. No. 5,291,626, which issued to Molnar et al on Mar. 8, 1994, discloses a machine for cleansing articles. The machine, such as a dishwasher, incorporates a device for measuring the turbidity of a partially transparent liquid. The device includes a sensor for detecting scattered electromagnetic radiation and a sensor for detecting transmitted electromagnetic radiation.

U.S. Pat. No. 5,331,177, which issued to Kubisiak et al on Jul. 19, 1994, discloses a turbidity sensor with analog-to-digital conversion capability. The sensor is provided with a light source and a plurality of light sensitive components which are disposed proximate a conduit to measure the light intensity directly across the conduit from the light source and at an angle therefrom. The conduit is provided with a plurality of protrusions extending radially inward from the walls of the conduit to discourage the passage of air bubbles through the light beam of the sensor. The direct light beam and scattered light are compared to form a relationship that is indicative of the turbidity of the liquid passing through the conduit. The rate of change of turbidity is provided as a monitored variable.

U.S. Pat. No. 5,444,531, which issued to Foreman et al on Aug. 22, 1995, describes a sensor with light emitting diode current control for use in machines for washing articles. A plurality of fluid conditioned sensors are combined together to provide a sensor cluster that senses turbidity, temperature, conductivity and the movement of a ferromagnetic object. The plurality of sensors are attached to a substrate and encapsulated, by an overmolding process, with a light transmissive and fluid impermeable material. The sensor cluster can be disposed at different locations within a body of fluid and does not require a conduit to direct the fluid to a particular location proximate the sensor. In a preferred embodiment of the present invention, a circuit is provided which monitors the signal strength of the first and second light sensitive components in order to determine turbidity and, in addition, those signals strengths are also used to advantageously determine the most efficient magnitude of current necessary to drive a light source, such as a light emitting diode. By controlling the current to a light emitting diode as a function of the strength of light signal received by first and second light sensitive components, the turbidity sensor can be operated at a more efficient and effective level.

U.S. Pat. No. 5,446,531, which issued to Boyer et al on Aug. 26, 1995, describes the placement of a sensor, such as that described immediately above, within a pump housing of a dishwasher. The location of a turbidity sensor within a washing machine can have significantly advantageous effects on the accuracy and usefulness of the turbidity measurements.

Known dishwasher designs, whether they incorporate a turbidity sensor or not, operate in a manner which can be referred to as a "state" algorithm method. In other words, the machine changes completely from one state to another without the ability to assume intermediate states. More specifically, when a drain operation is performed, all of the liquid within the dishwasher is removed. If a new cycle is to be run, the container of the dishwasher is completely filled with clean water. Every time a cycle is run, the dishwasher is completely purged of its existing soiled water and then completely refilled with clean water. Known dishwashers do not incorporate any means for partially draining or partially filling the container within the dishwasher. As will be described in greater detail below, this known approach to washing dishes severely limits the flexibility of the dishwasher, particularly when it is provided with a turbidity sensor and a microprocessor that is able to monitor and analyze the signals provided by the turbidity sensor.

Because of the large amounts of energy consumed by the dishwasher during a typical washing procedure, it would be very beneficial if some means were provided to reduce the amount of water used by more intelligently analyzing the washing process and avoiding the absolute requirement of draining all liquid from the dishwasher during every cycle (;i.e., the period from filling to near complete draining of water from the wash container;) of the total dishwashing operation.

SUMMARY OF THE INVENTION

The preferred embodiment of the present invention is a method for washing an object which comprises the steps of providing a container and disposing the object within the container. An initial quantity of water is provided within the container and the water is caused to move into contact with the surface of the object within the container. This contact can be caused by the use of spray arms through which water is pumped and sprayed against the surface of the object. The present invention further comprises the steps of periodically measuring the turbidity of the water while the water is being caused to contact the surface of the object to provide a series of turbidity measurements over time. A first magnitude of a first characteristic of the turbidity is calculated prior to removing a first portion of the initial quantity of water from the container. The first portion of water is less than the initial quantity of water. In other words, this step of the method performs a partial drain of the water within the container. Following the removing step, the present invention calculates a second magnitude of the first characteristic of the turbidity measurement.

The preselected characteristic of the turbidity measurement can be any one or more of several characteristics. For example, it can be the absolute magnitude of the measured turbidity, the rate of change of the turbidity magnitude over time, the degree of variability of the turbidity measurements over time or the rate of change of the degree of variability of the turbidity of the water over time. By comparing the first and second magnitudes which were measured before and after the removal of the first portion of water, the present invention is able to determine the degree and character of particulates within the water as a function of the difference between the first and second magnitudes of the characteristic of the turbidity measurements.

In certain alternative embodiments of the present invention, clean water can be added to the remaining portion of water within the container following the removing step in order to compensate for the removed first portion from the initial quantity of water. This adding step can be performed before the second magnitude calculating step is performed on the remaining portion of water. In certain dishwashers, the removal of any substantial portion of water from the container may cause problems with the pump. The reduced amount of the initial quantity of water, as a result of the removing step, may cause the pump to cavitate or operate inefficiently. If these deleterious results are possible, the adding step should be performed immediately following the removing step.

Certain embodiments of the present invention monitor several characteristics of turbidity and use the combined information relating to these characteristics to determine the degree and character of particulates within the water by comparing a first magnitude of each of these characteristics to a second magnitude of the characteristics, wherein the first and second magnitudes were taken before and after the draining operation.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
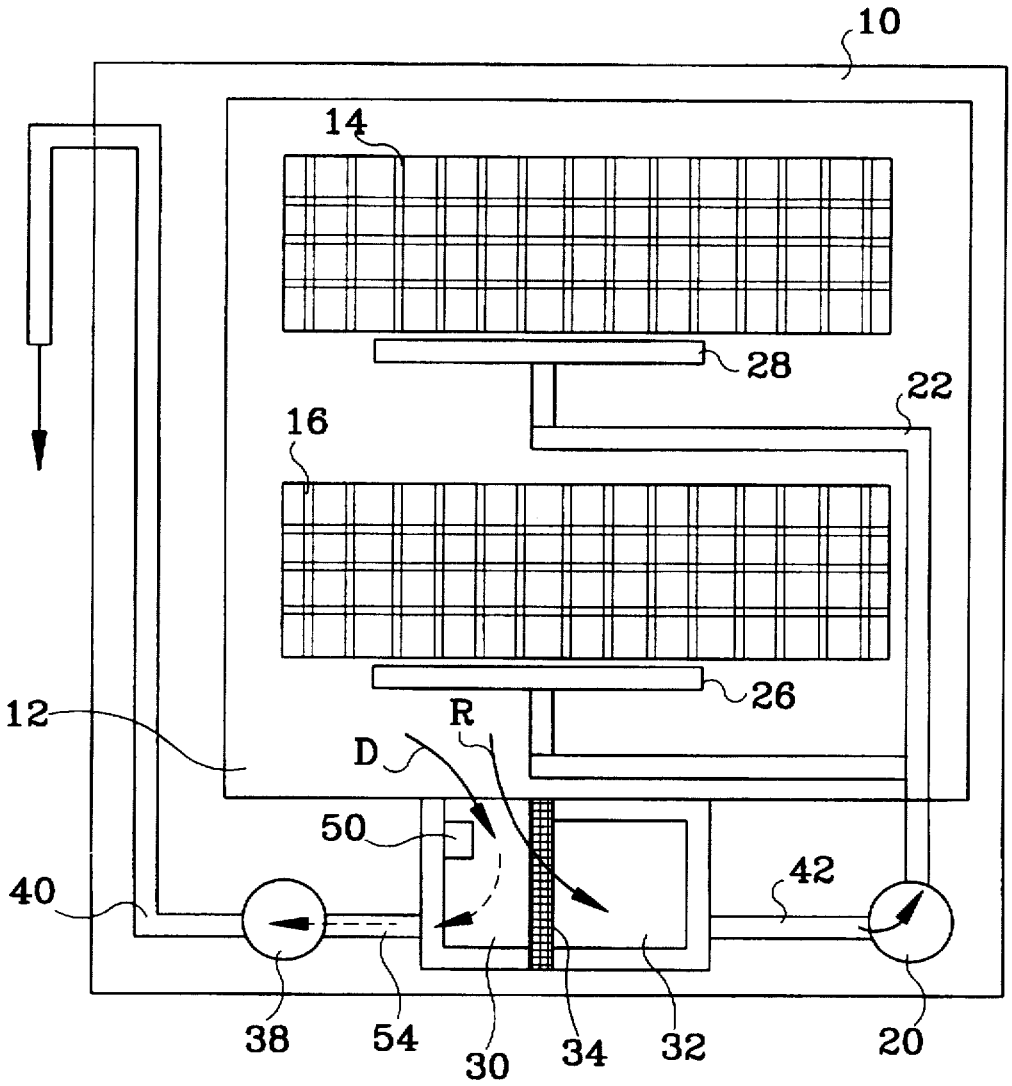
FIG. 1 is a schematic representation of a dishwasher that can be used to perform the method of the present invention.

Throughout the Description of the Preferred Embodiment, like components will be identified by like reference numerals.

FIG. 1 is a schematic representation of a dishwasher. The dishwasher 10 comprises a container 12 which is configured to contain a preselected amount of water within it. Within the container, two baskets, 14 and 16, are provided to hold a plurality of dishes and other eating and cooking utensils. During operation of the dishwasher 10, a recirculation pump 20 causes water to pass upward through the conduit identified by reference numeral 22 and through two spray arms, 26 and 28. The water is sprayed against the dishes in order to dislodge and remove particulates that are on the surfaces of the dishes and other utensils. After being sprayed against the objects within baskets 14 and 16, the water flows downward toward the bottom of the container 12 and into a containment having an unfiltered side 30 and a filtered side 32. A filter 34 separates these two sides of the containment. The unfiltered side 30 of the containment is connected in fluid communication with a drain pump 38 that can be used to cause the water to flow through conduit 40 and into a household sewage system. The filtered side 32 of the containment is connected in fluid communication with the recirculation pump 20 by conduit 42.

With the recirculation pump 20 in operation, water flows downward into the containment and through the filter 34, as represented by arrow R, to be recirculated through the spray arms, 26 and 28. Large particulates within the water, which have been dislodged from the dishes by the spraying procedure, will be unable to pass through the filter 34 and will, as a consequence, remain in the unfiltered side 30 of the containment. A turbidity sensor 50 is disposed within the containment to monitor the turbidity of the fluid therein. In a most particularly preferred embodiment of the present invention, the turbidity sensor 50 is disposed within the unfiltered side 30 of the containment in order to be able to measure and monitor the presence of both large and small particulates within the liquid.

When the drain motor 38 is operated, the water within the containment will flow from the unfiltered side 30 to drain conduit 54, the drain pump 38 and drain conduit 40. As a result of the operation of the drain pump 38, particulates that are too large to pass through the filter 34 will be removed through the drain system of the dishwasher.

During normal operation of the dishwasher 10, large particulates will collect in the unfiltered side 30 of the containment while smaller particulates will pass through the filter 34 to the filtered side 32 of the containment and be recirculated through the spray arms, 26 and 28. As a result, the smaller particulates will tend to be homogeneously distributed throughout the total quantity of liquid within the machine while the larger particulates will tend to congregate within the unfiltered side 30 of the containment. The present invention takes advantage of knowledge regarding the degree and character of the particulates within the liquid so that decisions can be made regarding the advisability of performing a full drain of the container 12 or a partial drain so that further information can be obtained.

With continued reference to FIG. 1, it should be understood that the turbidity sensor 50 can be provided with numerous transducers in combination with a microprocessor or microcomputer that is able to receive signals from the turbidity transducer, calculate certain characteristics based on those received signals and perform certain analysis with regard to changes in the calculated variables during the operation of the dishwasher and both before and after a partial drain operation. Although the turbidity sensor 50 is illustrated in a highly schematic manner in FIG. 1, it should be understood that it can be provided with the capabilities described in the United States patents cited above. In a preferred embodiment of the present invention, the method of washing dishes is controlled by a microprocessor or microcomputer that can be contained within the housing structure of the turbidity sensor 50. Alternatively, the method of the present invention can be performed by a controller contained within the main controller of the dishwasher which is located away from the turbidity sensor 50. The precise means by which the method of the present invention is performed and the microprocessor or microcontroller which performs the method is not limiting to the scope of the present invention. Turbidity sensors described in the patents cited above are suitable for these purposes.

In order to fully understand the operation of the present invention, it is necessary to understand certain characteristics about turbidity in the fluid of a dishwasher and how these characteristics can vary as a function of the type of dishwashing load being cleaned and the type of particulate matter adhering to the dishes prior to the cleaning operation. Through intensive empirical study of different types of dishwashing loads, various conditions of soiled dishes, many different types of debris within the liquid inside the dishwasher and many other variables pertaining to the operation of washing dishes, it has been determined that several characteristics of turbidity, measured over time, can reveal significant information that can be useful in performing the dishwashing operation with a minimum of energy consumption.

Figure 2:
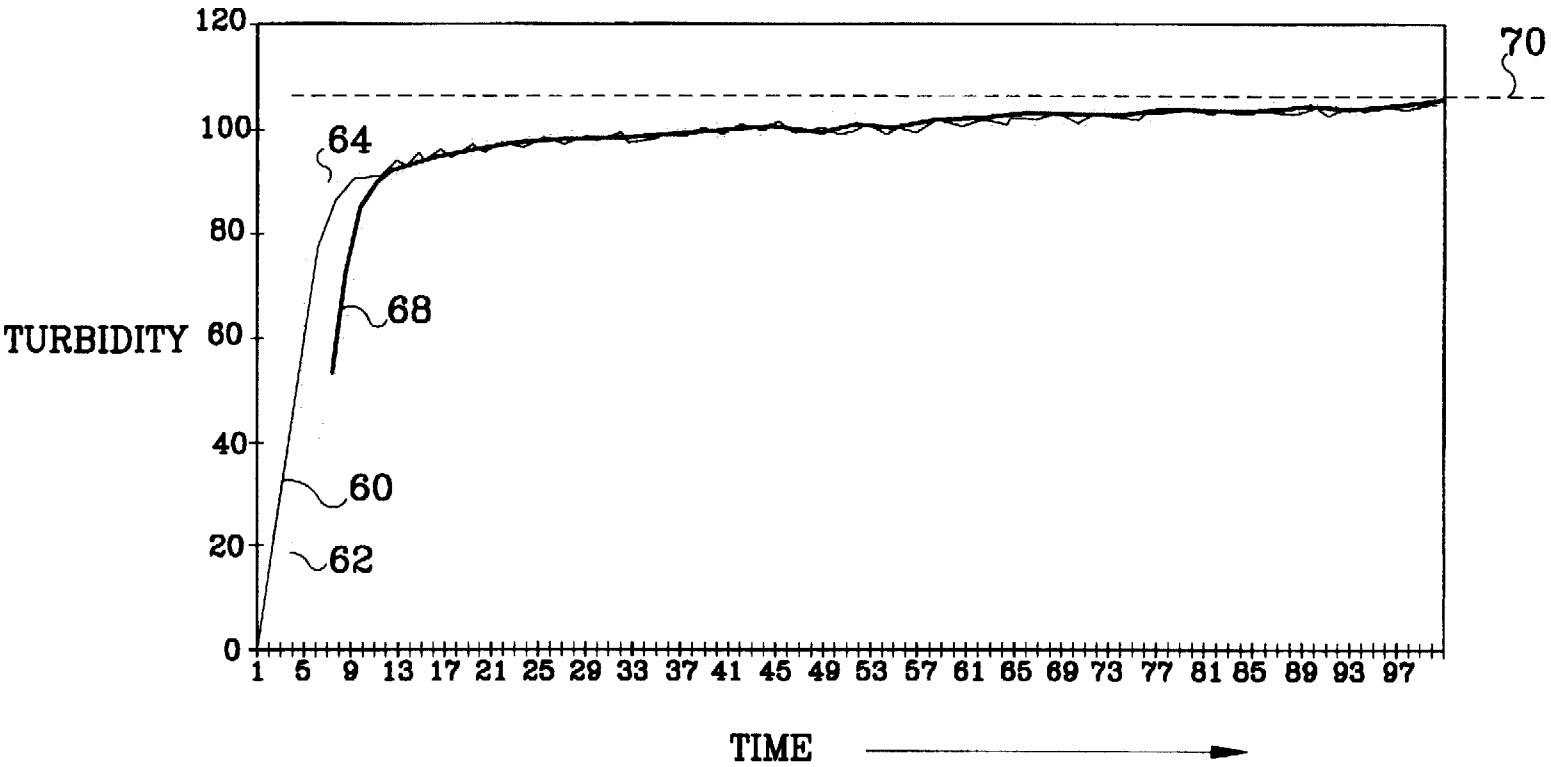
FIGS. 2 and 3 show two generally similar turbidity characteristics, but with different variabilities of turbidity measurements.

FIG. 2 is a graphical representation of a hypothetical series of turbidity measurements taken over time. In all of the graphical representations described below, it can be assumed that time and turbidity are measured in arbitrary relative units and do not prepresent any particular absolute magnitude of either time or turbidity. These graphical representations are provided for illustrative purposes and do not represent any actual empirical measurements.

In FIG. 2, a series of sequential independent turbidity measurements is defined by line 60. It can be seen that a certain degree of variability of the measurements provides a relatively jagged line 60. Two dotted lines, 62 and 64, are provided to illustrate the upper and lower boundaries of this variability. Dotted line 62 is the lower boundary and dotted line 64 is the upper boundary. Although not directly related to the operation of the present invention, the upper boundary 64 and lower boundary 62 can be calculated by a microprocessor in any one of several ways. As the series of individual turbidity measurements are taken, the highest and lowest individual measurements taken over a preselected span of time can be used to define these upper and lower boundaries. As will be described in greater detail below, the magnitude of difference between the upper and lower boundaries can provide important information regarding the degree and character of particulates in the liquid of the dishwasher. Line 68 represents a moving average of a plurality of prior turbidity measurements of line 60. In other words, as the plurality of turbidity measurements are sequentially received, represented by line 60, a moving average 68 is maintained by the microprocessor in order to smooth the otherwise jagged curve 60. A moving average of the previous five or ten values can possibly be used to perform this smoothing function. The details with regard to the manner in which the various calculations are made do not limit the present invention. Rather, these details should be specifically determined by those skilled in the art as a function of the detailed application of the present invention and the specific goals that are intended to be achieved by the application.

With continued reference to FIG. 2, it can be seen that the information provided by the turbidity sensor 50 over time and made available to the microprocessor can easily be used to determine at least four characteristics of the fluid within the dishwasher. A first characteristic is the absolute value of the turbidity reading 60 at any particular instant in time. A second characteristic can be the rate of change of the absolute values of turbidity over time. A third characteristic can be the magnitude of variability of the turbidity signals as represented by the difference between the upper boundary 64 and the lower boundary 62 at any instant in time. A fourth characteristic can be the rate of change of this degree of variability over time. Each of these characteristics, as will be described in greater detail below, can provide significant information by itself and can also provide very useful information in combination with the other characteristics.

With continued reference to FIG. 2, several conclusions can be reached by observing the characteristics of the turbidity measurements. For example, with reference to the arbitrary scale of the time line, the average turbidity 68 has initially risen rather quickly and has become generally asymptotic to dashed line 70 which represents a turbidity magnitude. This indicates that the debris has been washed from the surfaces of the dishes rather quickly and has been mixed with the liquid to raise its overall turbidity. The brief period of time required for the turbidity to become asymptotic to line 70 indicates that the food particles removed from the dishes were not severely baked on or dried on to the dishes. The shape of the curves in FIG. 2 also indicate that, after the period of time between time unit 17 and time unite 33, no significant additional particulates have entered the fluid to raise its turbidity magnitude.

With continued reference to FIG. 2, it can also be seen that the variability of line 60 is rather small. This variability, defined by the magnitude of difference between the upper boundary 64 and lower boundary 62, can represent the amount of large particulates within the fluid. For example, if the fluid contains a high degree of large food particles, those large food particles will pass through the turbidity sensor and momentarily cause very high turbidity readings because of the ability of the large particles to block the light used to make the turbidity measurements. As the large particle passes through the detection zone of the turbidity sensor, large turbidity magnitudes will be measured immediately after and immediately before much lower turbidity magnitudes are measured. This will cause wide fluctuations in the absolute magnitudes of the series of turbidity measurements. A comparison of FIGS. 2 and 3 will illustrate this effect.

Figure 3:
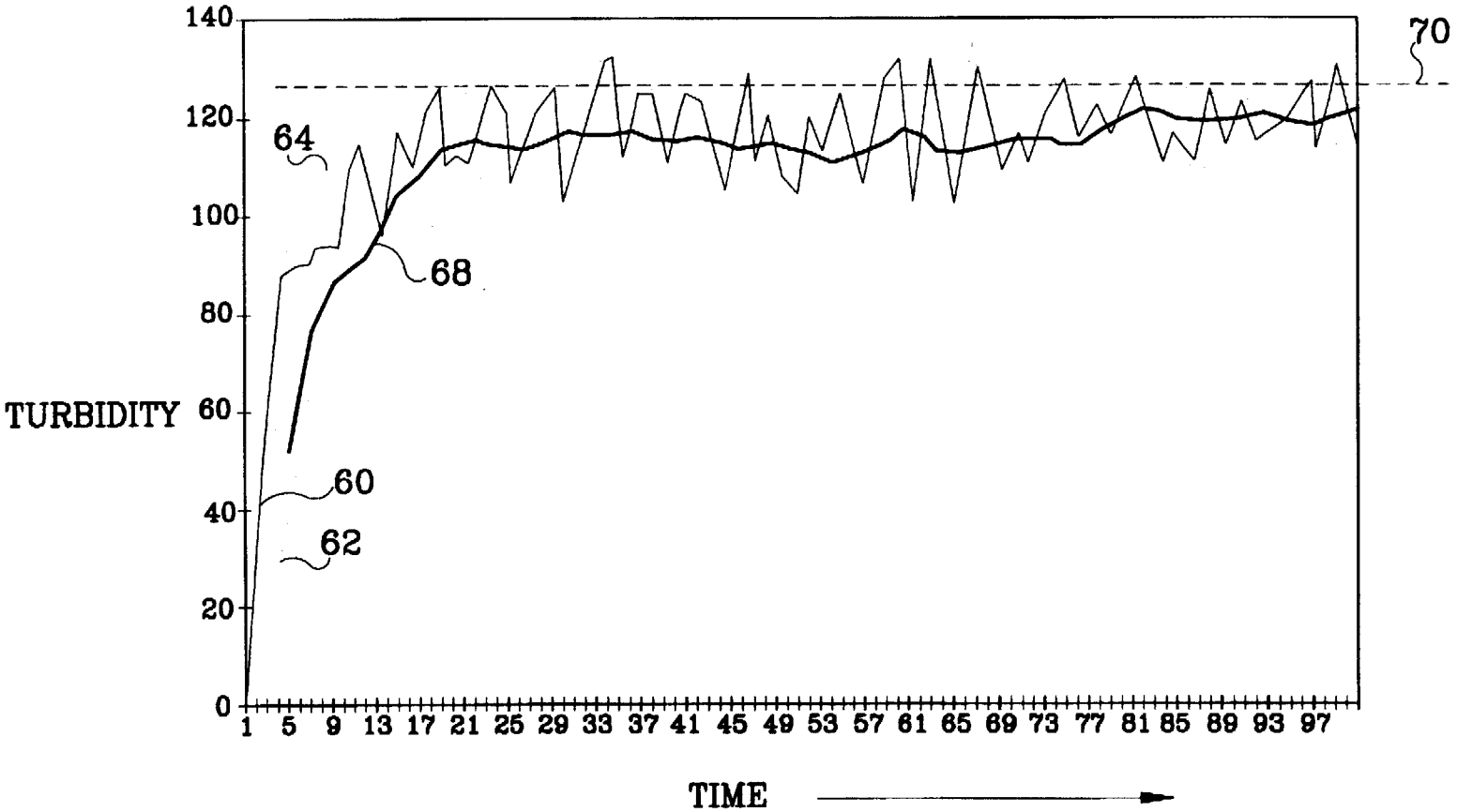

In FIG. 3, as in FIG. 2 described above, line 60 represents the series of turbidity measurements made over a period of time, line 68 represents a moving average of the individual measurements of turbidity, line 62 represents a lower boundary of the series of turbidity measurements and line 64 represents an upper boundary. In FIG. 3, the difference between the upper and lower boundaries, 64 and 62, show a higher degree of variability of the turbidity measurements. In other words, over a preselected brief period of time, the maximum and minimum measurements differ by a greater amount than that which is represented in FIG. 2. Although the initial rise of turbidity from zero to an asymptotic level occurs in approximately the same period of time, the apparent randomness or wide variation in value of the turbidity measurements indicates that the graphical representation in FIG. 3 was taken with much larger food particles in the vicinity of the turbidity sensor. Comparing FIGS. 2 and 3 to each other, certain assumptions can be made by interpreting the two graphical representations. First, it can be assumed that the particulates relating to FIG. 2 are much smaller than that particulates relating to FIG. 3. Secondly, it can be inferred that the particulates in both cases were easily removed from the dishes in a relatively short period of time. Conforming to this assumption, the lines of turbidity remain generally constant after time unit 13 until at least time unit 97. This shows that no significant amounts of food particles were removed after the initial cleansing between time units 1 and 25. Therefore, it can be inferred that no baked-on or dried food is on the surfaces of the plates.

Figure 4:
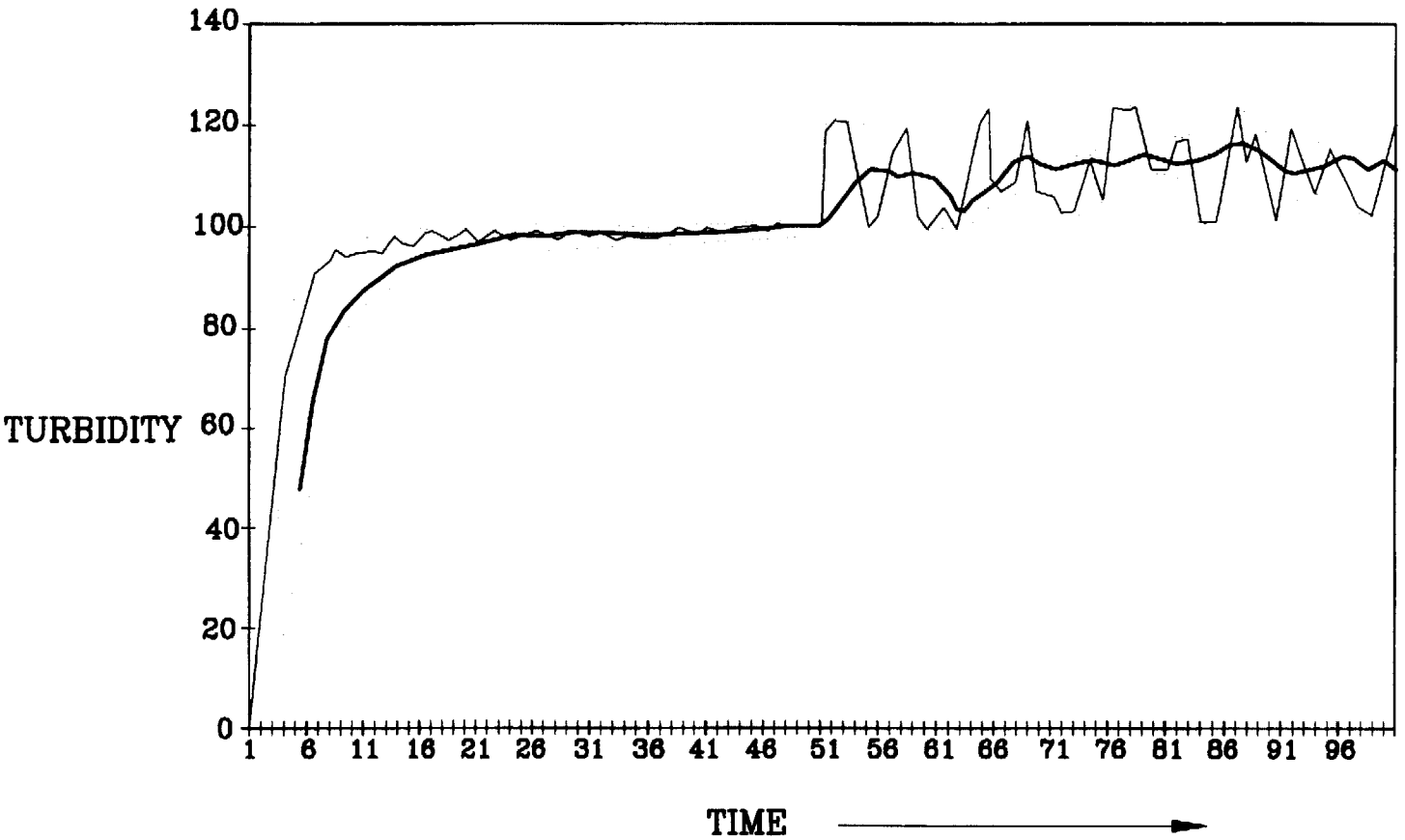
FIG. 4 shows an abrupt change in the variability of turbidity measurements during a wash cycle.

FIG. 4 represents a situation in which the initial fifty time units show relatively small particulates that were rapidly removed from the dishes in a relatively short time period between time unit 1 and time unit 15. Then, after the turbidity measurements became asymptotic to a turbidity measurement of approximately 100, the variability of turbidity measurement rapidly increased as represented by the divergence of the upper boundary 64 and lower boundary 62. These boundaries diverged because of the increased variability of the turbidity measurements as represented by line 60. The situation shown in FIG. 4 can be interpreted to indicate that an initial washing of the dishes, until time unit 50, rapidly removed small particulates from the dishes and caused them to be uniformly distributed in suspension within the fluid. Then, beginning with time unit 50, the continued spraying of the dishes began to cause larger particulates to become dislodged from the dishes. As a result, the larger particles moved past the turbidity sensor in a nonuniform manner and caused the increased variability in signal 60. The situation hypothetically represented in FIG. 4 can occur as a result of continued spraying of the dishes with hot water which initially removes small particles from the dishes and then, after a continued period of washing, begins to dislodge the larger particulates. This condition can be identified by monitoring the rate of change of variability over time. In other words, the variability, which is defined as the magnitude of the difference between the upper boundary 64 and the lower boundary 62, changes from a relatively small degree of variability prior to time unit 50 to a much larger degree of variability after time unit 50 as shown in FIG. 4.

Figure 5:
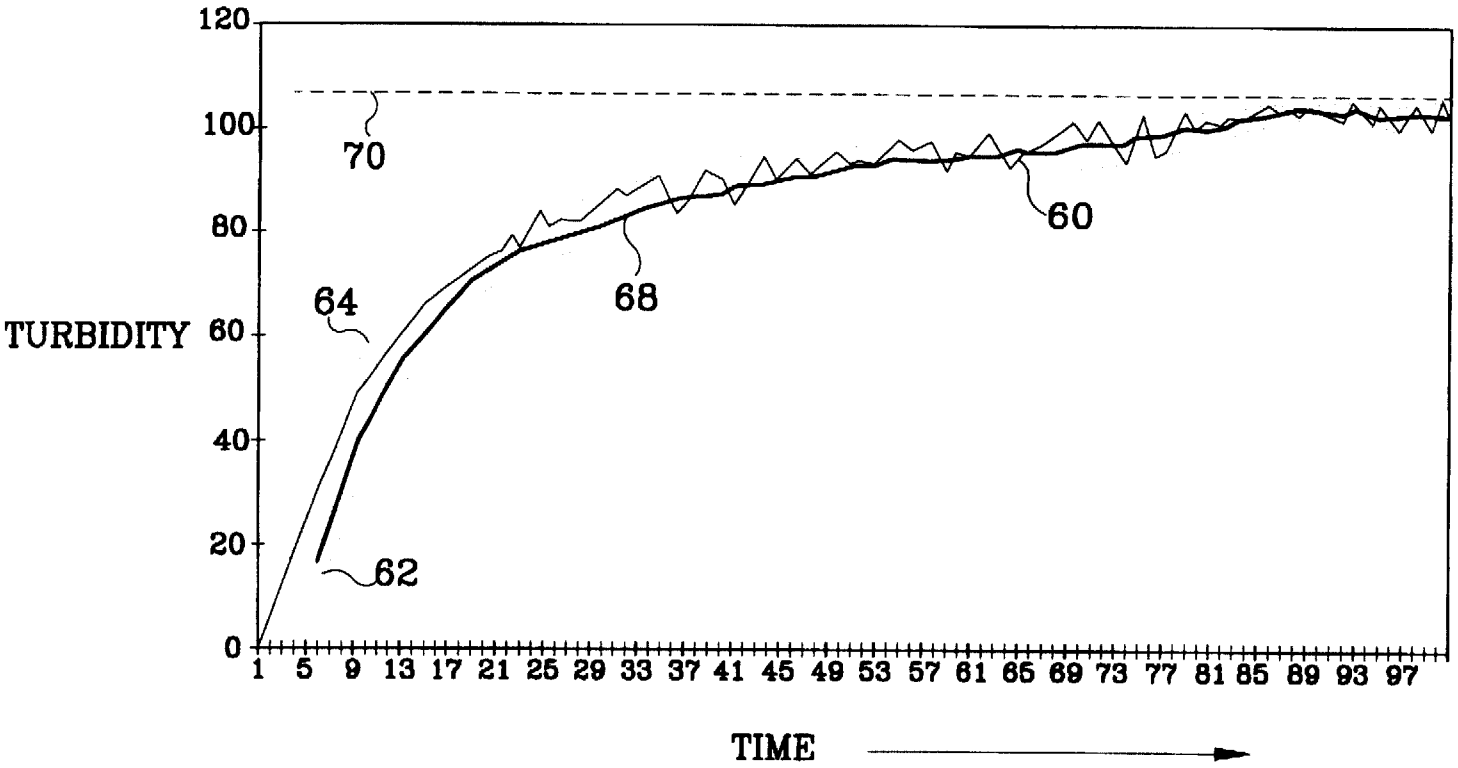
FIGS. 5, 6 and 7 show generally similar turbidity curves, but with different magnitudes of variability of turbidity measurements.

FIG. 5 represents a hypothetical turbidity pattern and is intended to show a subtle, but identifiable, difference between it and the pattern shown in FIG. 2. With reference to FIGS. 2 and 5, both average turbidity curves 68 eventually become generally asymptotic to dashed line 70. However, FIG. 2 represents a circumstance where the turbidity rises much more rapidly during the first several time units than the situation shown in FIG. 5. In FIG. 5, the turbidity rises at a more gradual rate and does not approach the dashed line 70 until approximately time unit 65. The situation shown in FIG. 5 can be interpreted to indicate that the food particles were not extremely loose on the surfaces of the dishes, but required some agitation by the water spray to dislodge it. However, the particulates began to become dislodged at the very beginning of the cycle and continued to be dislodged at a moderate rate relative to that represented in FIG. 2. The implication of these assumptions can dictate the subsequent procedure to be performed by the dishwasher. For example, with respect to FIG. 2, a microprocessor could logically decide that at time unit 33 all of the food particulates have been removed from the dishes and further washing will only serve to cause the particulates to again adhere to the surfaces of the dishes. Therefore, the situation in FIG. 2 can be responded to by a decision to completely drain all of the water from the container of the dishwasher. The situation represented in FIG. 5, on the other hand, indicates that food particulates continue to be dislodged from the dishes and placed into solution. The increasing turbidity, up to time unit 70, indicates that further washing is advisable because the spraying of water on the dishes appears to have the effect of continued removal of food particles from the dishes. Therefore, comparing FIGS. 2 and 5, the rate of change of the average turbidity 68 over time represents helpful information that can be used to interpret the degree and character of particulates within the water.

Figure 6:
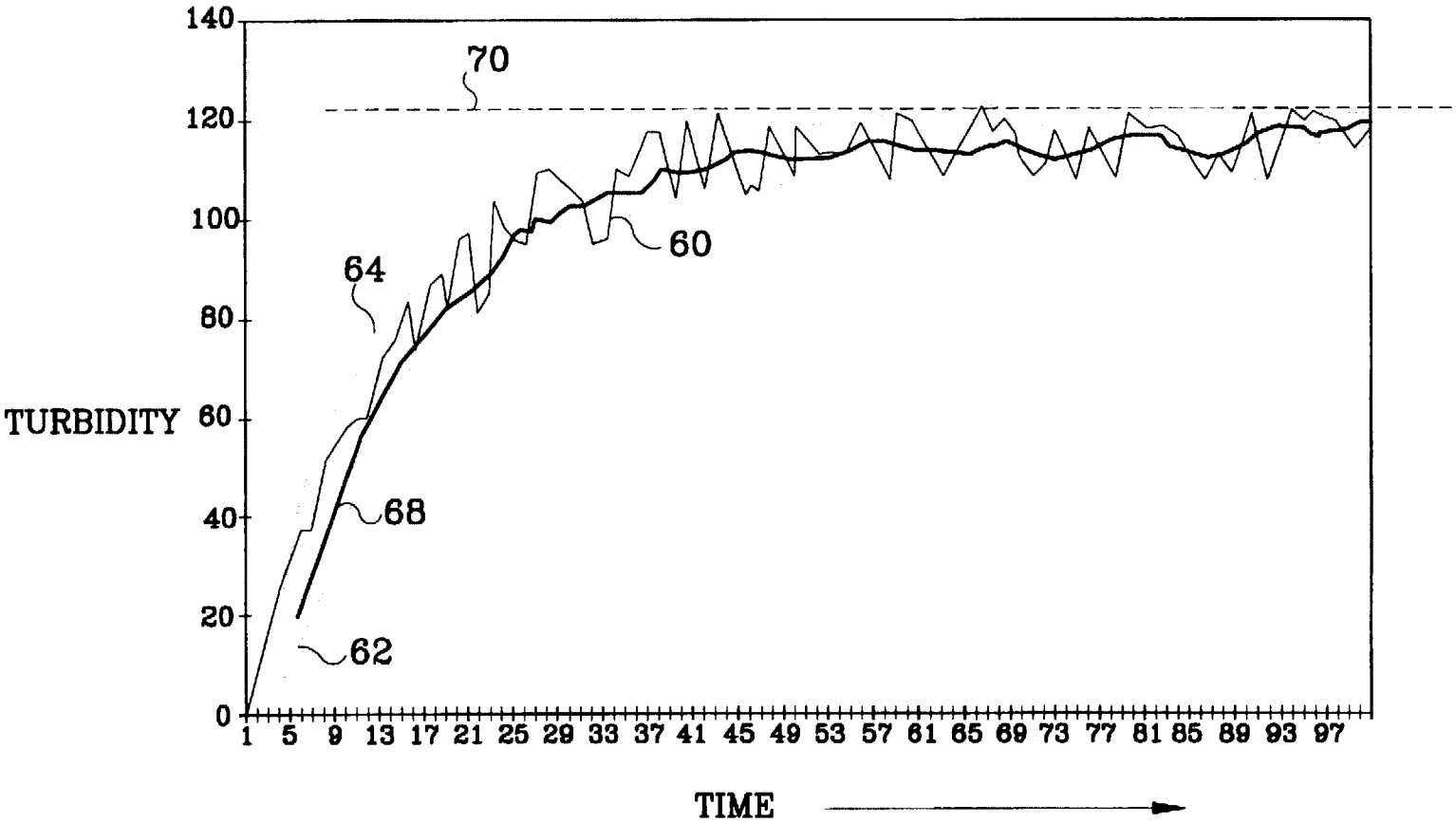

FIG. 6 represents a situation in which the general shape of the average turbidity curve 68 is basically similar to that shown in FIG. 5, but the variability of the readings represented by line 60 is much greater. In other words, the distance between the upper boundary 64 and the lower boundary 62 in FIG. 6 is much greater than in FIG. 5. As a result, a similar conclusion with regard to the rapidity of the food particles being dislodged from the dishes can be made as was made with respect to FIG. 5. However, because of the significantly larger variability of the measurements represented by line 60, it is apparent that the food particles are much larger in the case of FIG. 6 than in FIG. 5.

Figure 7:
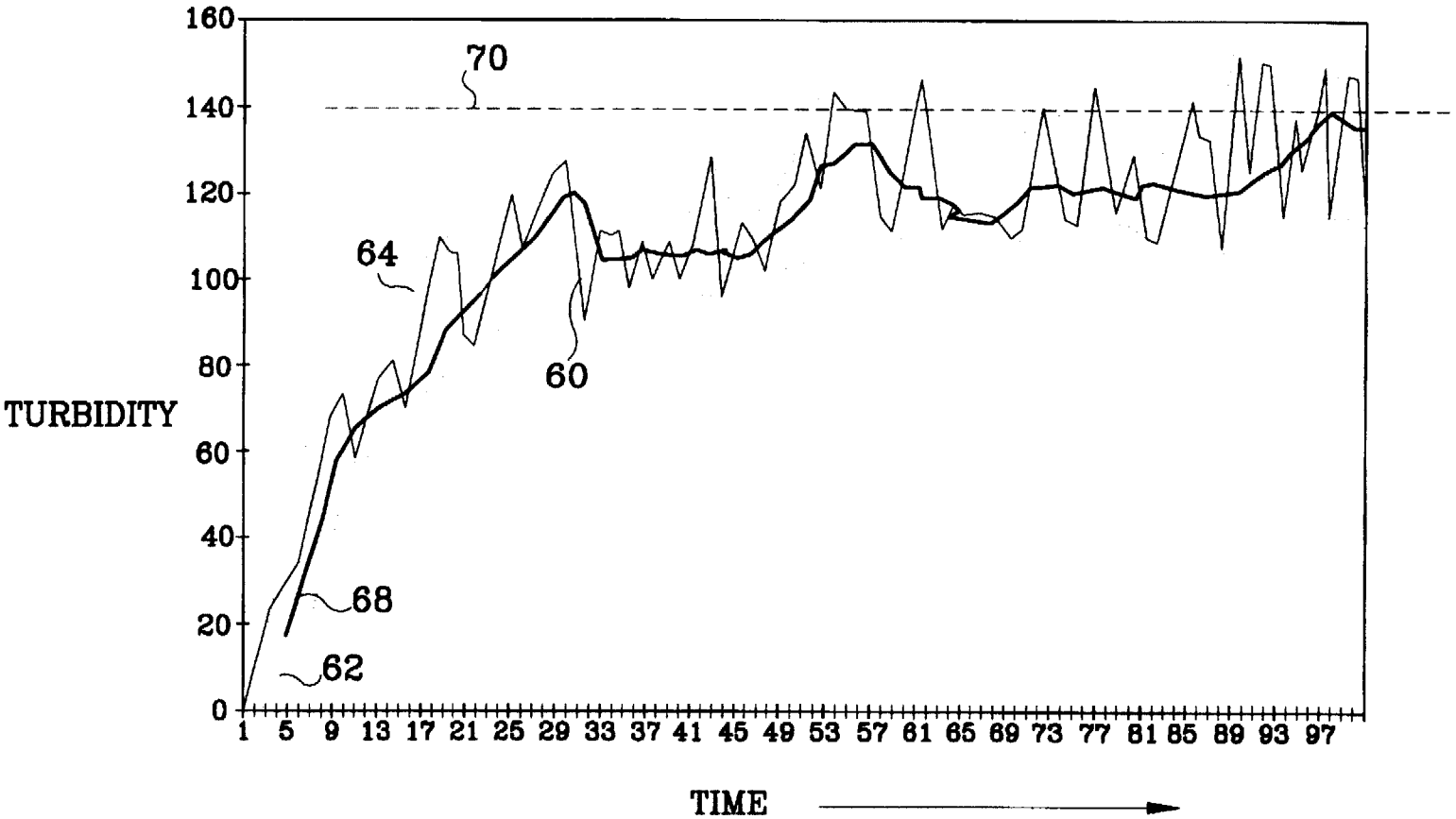

FIG. 7 represents a situation where the average turbidity curve 68 follows an overall pattern that is generally similar to FIGS. 5 and 6, but with a variability that is even larger than that represented in FIG. 6. The situation shown in FIGS. 6 or 7 can lead to a logical assumption concerning the advisability of removing a portion of the initial quantity of water from the container 12 in the dishwasher 10. With reference to FIGS. 1 and 7, it can be seen that the turbidity sensor 50 is disposed within the unfiltered side 30 of the containment at the bottom of the dishwasher. As a result, the graphical representation in FIG. 7 can lead to the conclusion that the high degree of variability of signal 60 is caused by a significant amount of large particulates in the unfiltered side 30 and surrounding the region in which the turbidity sensor 50 is disposed. This could lead to a logical conclusion that the removal of a portion of the water would clear the larger particulates out of the unfiltered side 30 and reduce the variability of the turbidity curve 60. A removal of a portion of the initial quantity of water will also prevent a situation in which the larger particulates become broken down to smaller particulates and begin to recirculate through the spraying system to be again attached to the surfaces of the dishes.

Figure 8:
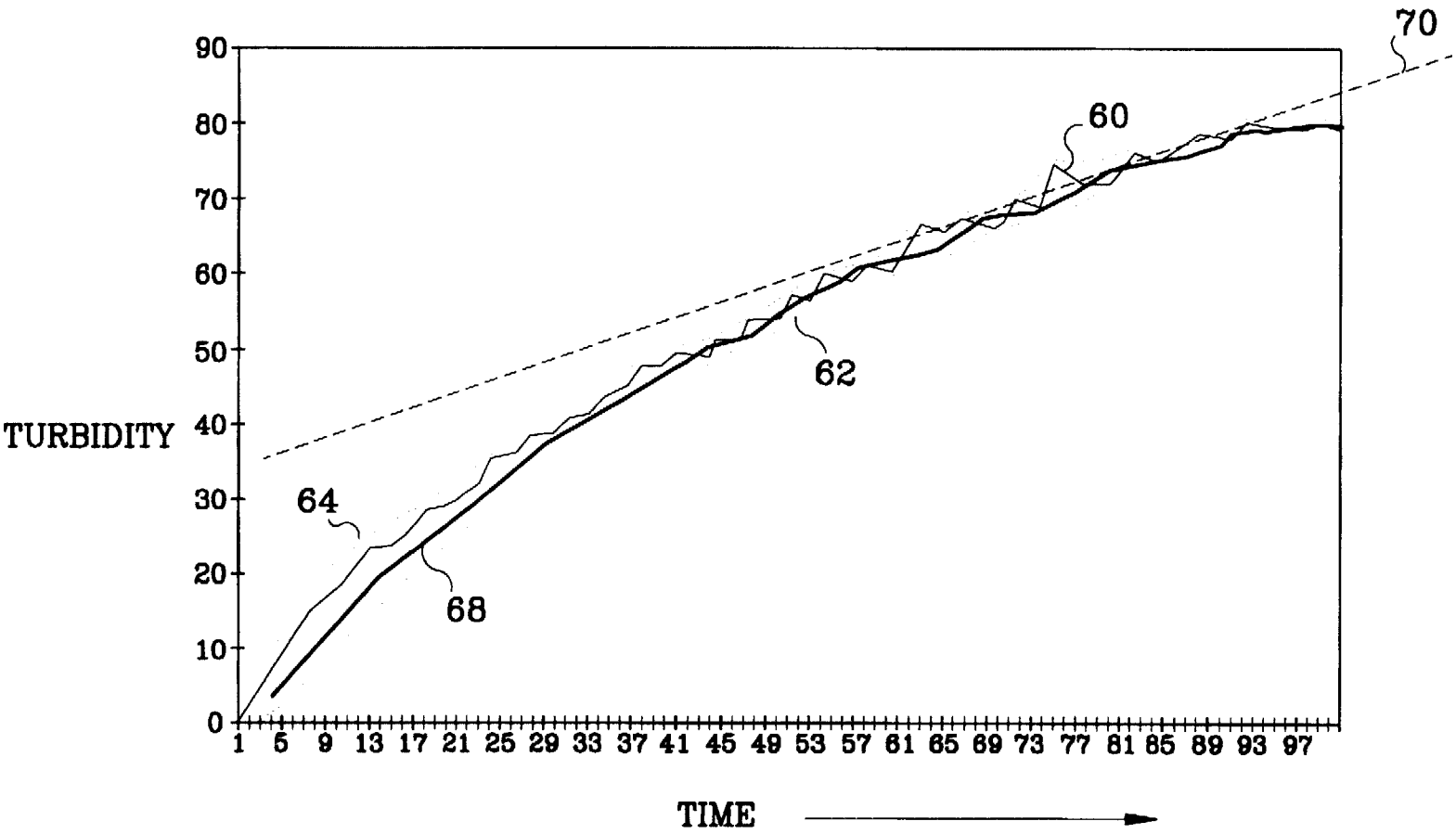
FIG. 8 and 9 show generally similar turbidity curves with different magnitudes of variability.
Figure 9:
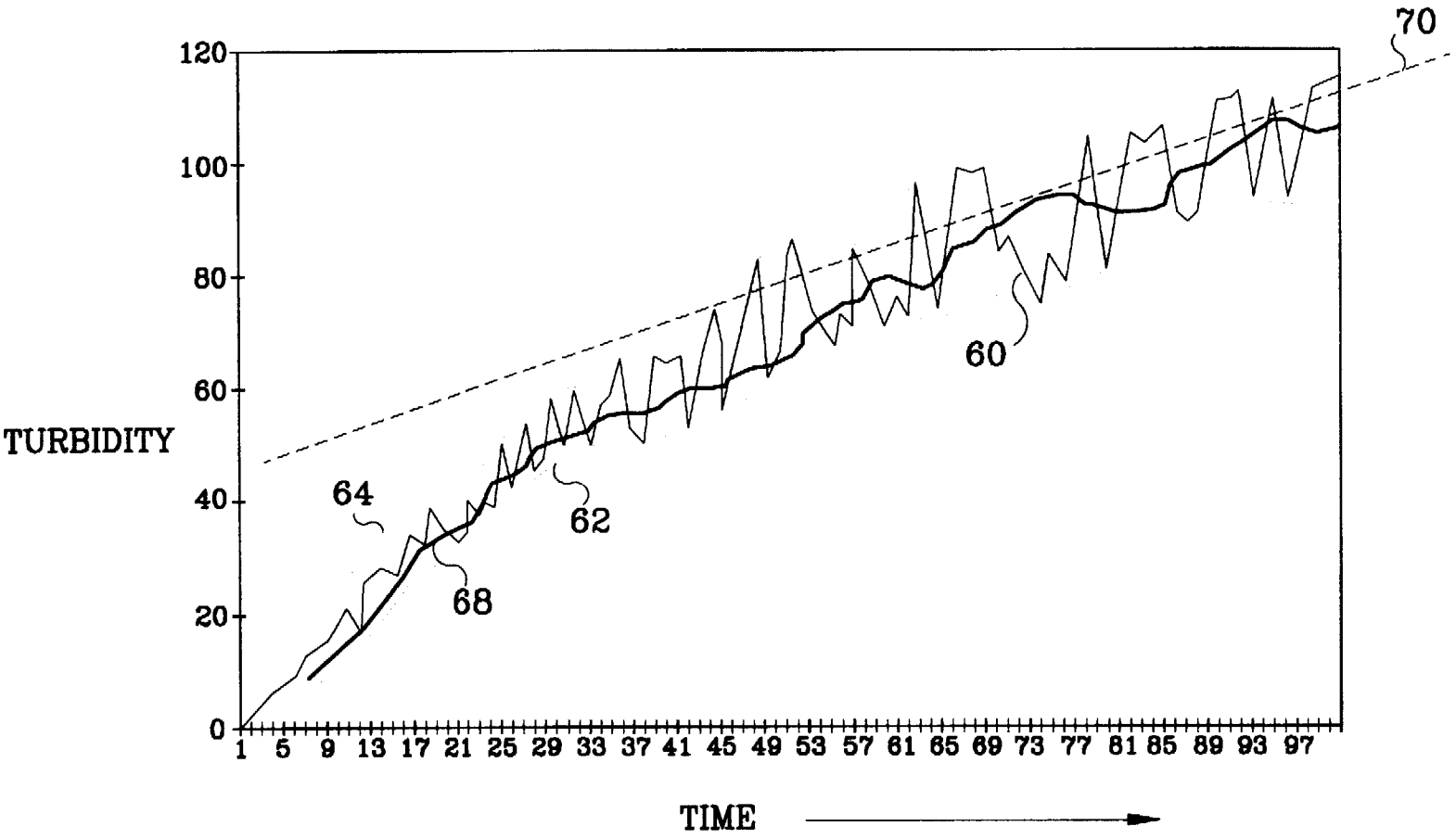

FIGS. 8 and 9 are provided to illustrate an even more gradual removal of particulates from the dishes. Both situations represented in FIGS. 8 and 9 show a more gradual removal of particulates from the dishes than that described above in conjunction with FIGS. 5, 6 and 7. FIG. 9 is intentionally illustrated as having a significantly higher variability of turbidity readings than FIG. 8. In other words, the upper threshold 64 and the lower threshold 62 are much wider apart in FIG. 9 than in FIG. 8, indicating a larger amount of larger particulates in the water. Comparing FIGS. 2, 5 and 8, it can be seen that the removal of particulates from the dishes can result in significantly different average curves even though the variability of turbidity in these three examples is generally similar. In FIG. 2, the small particulates were rapidly removed from the dishes by time unit 20 and further washing had very little affect in the overall amount of particulates suspended in solution within the water of the dishwasher. FIG. 5 illustrates a slower removal of particulates from the dishes and FIG. 8 shows an even slower removal of particulates. The asymptote 70 in these three Figures is provided to show the rate of removal of particulates from the dishes which is achieved at approximately the 97th time unit. In FIG. 8, it can be seen, that further washing beyond time unit 97 could have beneficial results since there is a continued removal of particulates from the dishes. In FIG. 5, continued washing would not appear to have beneficial results and, in FIG. 2, it is clear that further washing would merely be a waste of time and energy.

Figure 10:
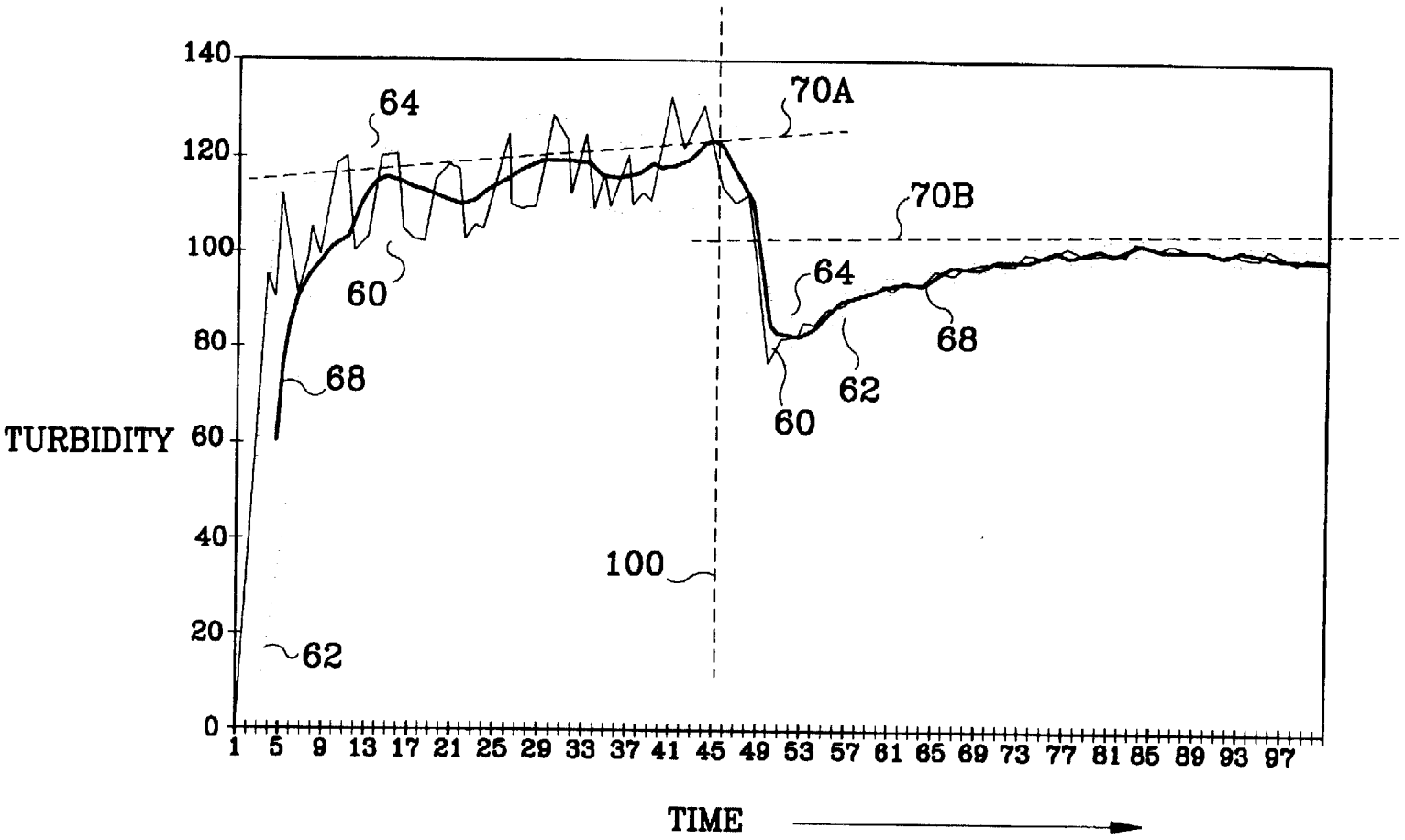
FIG. 10 shows a turbidity curve, as a function of time, which illustrates the effect of a partial drain of a portion of the water from a dishwasher.

FIG. 10 is intended to show the advantages of the procedure of the present invention. After taking turbidity readings to define a particular characteristic of turbidity, the present invention removes a portion of the initial quantity of water within the dishwasher. After the removal of the portion of water, a second magnitude is obtained for the same characteristic of turbidity. By comparing the two magnitudes of the characteristic of turbidity, significant information regarding the dishwashing process can be derived. In FIG. 10, vertical dashed line 100 represents the time at which a portion of the initial quantity of water was removed from the dishwasher. This was accomplished by energizing the drain motor 38 described above in conjunction with FIG. 1 and evacuating the contents from the unfiltered side 30 of the containment at the bottom of the dishwasher. Since the filter 34 prevents the large particulates from passing into the filtered side 32 of the containment and then be recirculated, the draining of a portion of the initial quantity of water within the dishwasher will have the effect of removing most of the larger particulates from the unfiltered end 30. The hypothetical example represented in FIG. 10 shows a relatively large variability of turbidity, between the upper boundary 64 and lower boundary 62, prior to the removal of the portion of water at the time represented by dashed line 100. After the removal of the portion of water, the average turbidity 68 experiences a reduction and the variability, represented as the difference between the upper boundary 64 and lower boundary 62, experiences a significant reduction. This indicates that the removal of water at dashed line 100 also removed the large particulates in the unfiltered section 30 that were causing the higher variability.

In one embodiment of the present invention, four different characteristics would be monitored prior to the removal of water at dashed line 100 and again after the removal of water at dashed line 100. These four characteristics are the absolute turbidity magnitude as represented by moving average 68, the rate of change of the absolute value of turbidity as represented by the slope of line 68, the variability of the turbidity measurements as represented by the difference between lines 64 and 62 and the rate of change of the variability as represented by the comparison between the variability to the left of dashed line 100 and the variability to the right of dashed line 100.

With continued reference to FIG. 10, a potential chronology of events could have occurred in the following manner. First, a microprocessor would observe that in the time period between time unit 1 and time unit 10 a relatively rapid removal of food particles from the dishes occurs. Then, because of the slight slope of asymptote 70A, some additional particulates are being removed from the dishes, but at a significantly reduced rate compared to the initial few time units of washing. It can also be observed that a relatively high variability exists and this indicates that large particulates are in the solution, having been removed by the spraying process. At approximately time unit 48, a decision is made to remove a portion of the initial quantity of water within the dishwasher. If the initial quantity of water was 12 quarts, perhaps two to four quarts can be removed to create a remaining portion of eight to ten quarts at the time represented by dashed line 100. If a large amount of large particulates are disposed within the unfiltered side 30 of the containment in FIG. 1, this drain operation is likely to cause most of the larger particulates to be removed and pumped toward the sewage system. If second magnitudes of the various turbidity characteristics are taken after dashed line 100 and the removal of the portion of water, significant changes can be seen. First, the actual turbidity readings 60 are instantaneously reduced and this is followed soon after by a reduction in the mathematical moving average 68 of those readings. More significantly, the decrease in variability is pronounced after dashed line 100. This indicates that the large particulates have been removed from solution as a result of the removal of the portion of water. Not only was the variability reduced, but the overall turbidity 68 was significantly reduced also. This indicates that the large particles represented a relatively significant portion of the overall turbidity. The smaller particles remaining in solution represent the turbidity after dashed line 100 which, after the initial reduction, begin to approach line 70B asymptotically.

With continued reference to FIG. 10, it should be understood that the removal of the portion of water could be followed immediately by a replacement of an equal amount of water prior to taking the second magnitudes of the various characteristics of turbidity from the remaining portion of water. In certain dishwashers, the pumps are adversely affected if a full complement of water is not present within the machine. Less than the initial quantity of water will result in propeller cavitation and less than efficient operation of the operation of the pumps.

In known methods of operating dishwashers, the water within the dishwasher is not partially removed at any time during the normal cycle for the purpose of creating a perturbation in the turbidity which is then measured. Instead, most known drain procedures continue until virtually all of the water is removed from the dishwasher. The container is then refilled with clean water for the next cycle. In certain dishwashers made for use in Europe, a momentary flushing of particulates occurs during the initial part of a cycle, but not for the purposes toward which the present invention is directed. In clear contradistinction to this "state" operation technique, the present invention intentionally performs a partial drain during which a portion of the water is removed for the purpose of creating a perturbation to the system. This preselected perturbation can have a significant effect on one or more of the turbidity characteristics described above. By sensing the change in magnitude of one or more of the turbidity characteristics, significant beneficial information can be obtained with regard to the washing process.

In the following discussion relating to equations 1–5, certain expressions for turbidity T will be developed in terms of the amount of food particles F, the volume V of certain portions of the dishwasher, the amount of small and uniformly distributed food particles $F_{UNIFORM}$, the amount of nonuniform larger food particles $F_{NONUNIFORM}$, the total volume of liquid $V_{TOTAL}$, the volume of fluid in the unfiltered portion 30 of the containment shown at the bottom of the dishwasher in FIG. 1 and the portion of the water $\Delta V$ that is removed between the reading of the first and second magnitudes of the turbidity characteristic as described above.

In equation 1, the turbidity T can be defined as the ratio of the food particles F to the total volume V of liquid in the dishwasher. This volume is typically between seven and twelve quarts of water.

$$T \propto F/V \quad (1)$$

More specifically, the turbidity T of the total amount of water in the dishwasher can be defined as the amount of small particles $F_{UNIFORM}$ which is uniformly distributed throughout the fluid divided by the total volume $V_{TOTAL}$ of the dishwasher plus the amount of larger particles that are generally congregated in the unfiltered portion 30 of the containment $F_{NONUNIFORM}$ divided by the volume $V_{UNFILTERED}$ of the unfiltered portion 30 in the containment. This is shown in equation 2 below.

$$T \propto ((F_{UNIFORM}/V_{TOTAL})+(F_{NONUNIFORM}/V_{UNFILTERED})) \quad (2)$$

As can be seen in FIG. 1, the unfiltered volume $V_{UNFILTERED}$ is significantly less than the total volume $V_{TOTAL}$ of the liquid within the dishwasher. This is shown in equation 3.

$$V_{UNFILTERED} < V_{TOTAL} \quad (3)$$

With reference to equations 1, 2 and 3, the total amount of food F comprises uniformly distributed food which are the small suspended particles throughout the dishwasher and larger particles that are nonuniformly distributed, primarily within the unfiltered portion 30 of the containment at the bottom of the dishwasher. As an example, milk would comprise extremely small particles that are uniformly distributed throughout the entire liquid within the dishwasher and would be homogeneous throughout the solution. However, pieces of meat, vegetables or pasta would comprise larger particles that would be nonuniformly distributed and remain primarily in the unfiltered portion 30. It can be assumed that the nonuniform food particles will collect in the vicinity within the unfiltered portion 30 to the left of the filter 34. Equation 2 takes into account that these two types of food particulates must be considered individually because of their different degrees of distribution throughout the liquid. Since the uniform food particulates are evenly dispersed throughout the dishwasher, the density of the food solution it contributes to the turbidity measurements is found by taking the total amount of the homogeneously distributed small particles and dividing that amount by the total water volume within the dishwashing machine. However, the larger nonuniformly distributed particulates collect in the unfiltered portion 30 near the turbidity sensor and the density of the nonuniformly distributed larger particulates must be calculated using only the water volume in the immediately vicinity of the turbidity sensor 50 within the unfiltered portion 30.

If a partial removal of some of the water is performed, and the drain outlet is located near the turbidity sensor 50 within the unfiltered portion 30 of the containment, the change in the total turbidity can be approximated through the use of equation 4. The portion of water removed from the dishwasher is identified as $\Delta V$. The change in the total turbidity of the total water within the dishwashing machine can be estimated for these purposes through the use of equation 4.

$$\partial T \propto ((F_{UNIFORM})(1-\Delta V/V_{TOTAL})/V_{TOTAL})+(F_{NONUNIFORM}+)(1-\Delta V/V_{UNFILTERED})/V_{UNFILTERED})) \quad (4)$$

Equation 5 can be developed from equation 4. In equation 5, it can be seen that since the volume $V_{UNFILTERED}$ is significantly less than the total volume $V_{TOTAL}$, the total turbidity level measured by the sensor is much more sensitive and changes more significantly when nonuniform food $F_{NONUNIFORM}$ is present in quantities which are comparable to the uniformly distributed food $F_{UNIFORM}$.

$$\partial T/\partial \Delta V \propto (-F_{UNIFORM}/V_{TOTAL}^2)-(F_{NONUNIFORM}/V_{UNFILTERED}^2) \quad (5)$$

In view of the equation shown above and with reference to FIG. 10, it should be understood that the removal of the portion of water at dashed line 100 will have a much more significant effect on the total turbidity level than if the particulates were made up of primarily smaller particles, such as milk. When the turbidity is primarily caused by very small particles, the removal of a relatively small portion of the liquid will have a very minor effect on the total turbidity within the dishwashing machine. On the other hand, if a significant proportion of the particulates in solution are large particles within the unfiltered portion 30, the removal of the portion of water will remove a high percentage of the larger particles trapped in the unfiltered portion 30 and this removal will have a much more significant effect on the overall turbidity. This situation is represented in FIG. 10.

Figure 11:
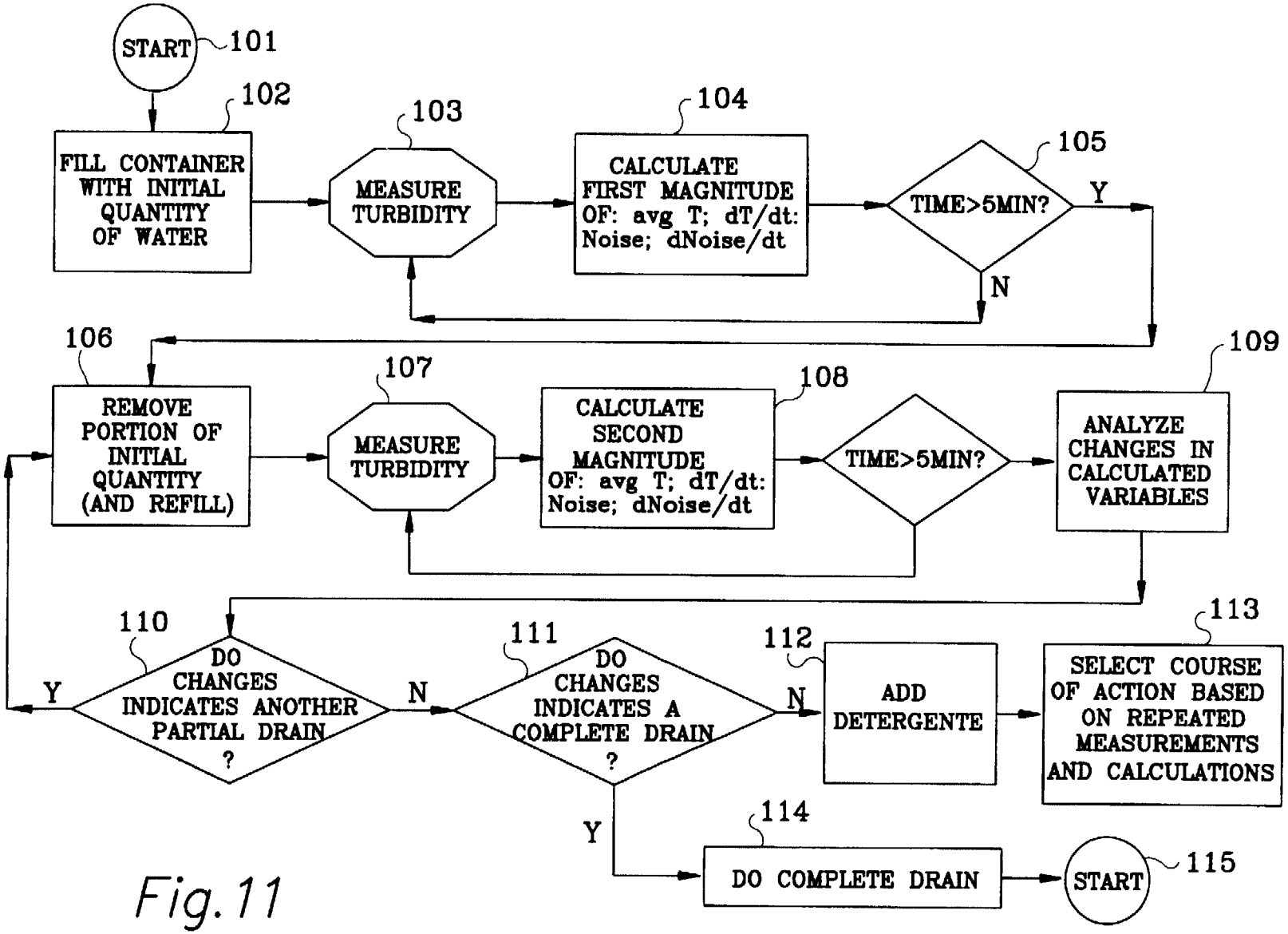
FIG. 11 is a flow chart which can perform the method of the present invention.

FIG. 11 is a representative flowchart showing how an algorithm can be developed which performs the various steps of the present invention. Each of the functional blocks in FIG. 11 is identified by reference numerals from 101 to 115. When the algorithm is begun at 101, the dishwasher container 12 is filled with an initial quantity of water that can comprise between seven and twelve quarts as described in functional block 102. The turbidity is measured while the recirculation pump 20 is operated to agitate and distribute water against the surfaces of the dishes within the dishwasher. This is described in functional block 103. The turbidity sensor continuously provides a sequence of periodic measurements, as indicated by functional block 104, for some preselected period of time, such as five minutes. The loop, which comprises functional blocks 103, 104 and 105, is performed for the preselected period of time in order to appropriately agitate the water and spray it against the surfaces of the dishes to obtain a representative first magnitude of the one or more turbidity characteristics described above. Then, at functional block 106, a portion of the water within the dishwasher is removed. This portion can comprise the removal of two to four quarts of water. Depending on the total amount of water in the dishwasher and the magnitude of the removed portion, clean water can then be used to replace the removed portion. Then, as described in functional block 107, the turbidity is again measured. In functional block 108, a second magnitude of the one or more characteristics is measured and the first and second magnitudes are compared at functional block 109. The analysis will yield information pertaining to the absolute magnitude of the turbidity over time, the absolute magnitude of the variability of turbidity measurements and the rate of change of the absolute magnitude of the variability of turbidity measurements over time. In addition, certain embodiments of the present invention can comprise further measurements relating to turbidity, such as conductivity. At functional block 110, the algorithm makes a decision with regard to the necessity for another partial drain. This decision can be based on the total effect seen when the first removal of water was performed. If another partial drain is not indicated, the algorithm determines whether or not a complete drain of all of the water from the dishwasher is indicated. As an example, if the rate of change of turbidity is extremely small, further agitation will probably not provide additional cleansing of the dishes. In other words, when the average turbidity 68, as shown in the figures, approaches a horizontal asymptote 70, further agitation is not indicated, particularly when the variability of the turbidity readings is significantly small. As an example, if the various turbidity characteristics indicate that very small particles of food make up a significant portion of the total particulate matter and additional food particles are not being removed from the surfaces of the dishes, further agitation of the water is deemed to be nonproductive and a complete drain will be performed. If this complete drain is indicated at functional block 111, it is performed at functional block 114 and the procedure is restarted. If a complete drain is not indicated, detergent can be added at functional block 112 and a further course of action can be determined based on repeated measurements and calculations of the turbidity characteristics. When the detergent is added, it would logically be expected that additional food particles will be dislodged from the surfaces of the plates and the turbidity magnitude will increase. The procedure shown in FIG. 11 can be repeated for each phase of the wash process. By incorporating a partial drain where a portion of the water is removed from the dishwasher, valuable information can be obtained that reduces the amount of water used during the total wash procedure.

Although the present invention has been described in considerable detail and illustrated with particular specificity to disclose various techniques which can be used to analyse the turbidity of water in a dishwasher, it should be understood that alternative techniques are also within its scope.

The embodiments of the invention in which an exclusive property or right is claimed are defined as follows:

1. A method for washing an object, comprising:

providing a container;

disposing said object within said container;

starting a first washing cycle by providing an initial quantity of water within said container, said cycle being the period from fill to near complete drain of said water in said container;

causing said water to contact the surface of said object;

periodically measuring the turbidity of said initial quantity of water while said water is being caused to contact said surface of said object to provide a series of turbidity measurements over time;

calculating a first magnitude of a first turbidity characteristic from said turbidity measurements of said initial water quantity;

removing a first portion of said initial quantity of said water from said container to obtain a remaining portion, said first portion being less than said initial quantity;

measuring the turbidity of said remaining portion;

calculating a second magnitude of said first turbidity characteristic from said turbidity measurement of said remaining portion; and determining the degree and character of particulates within said water as a function of the difference between said first and second magnitudes of said first characteristic of said turbidity measurements; and based upon said determination of degree and character, either removing from the container a second portion of the remaining portion, removing from the container all of the remaining portion, or proceeding with the remaining portion contacting the surface of the object.

2. The method of claim 1, further comprising:

adding clean water to said container to compensate for said removed first portion of said initial quantity of said water, said adding step being performed before measuring the turbidity of the remaining portion.

3. The method of claim 1, further comprising:

calculating a first magnitude of a second characteristic of said turbidity measurements of said initial water quantity; and calculating a second magnitude of said second characteristic of said turbidity measurement from said remaining portion.

4. The method of claim 3, further comprising:

calculating a first magnitude of a third characteristic of said turbidity measurements of said initial water quantity; and calculating a second magnitude of said third characteristic of said turbidity measurement from said remaining portion.

5. The method of claim 4, further comprising:

calculating a first magnitude of a fourth characteristic of said turbidity measurements of said initial water quantity; and calculating a second magnitude of said fourth characteristic of said turbidity measurement from said remaining portion.

6. The method of claim 1, wherein:

said first characteristic is a measurement of said turbidity of said water.

7. The method of claim 3, wherein:

said second characteristic is a rate of change of said turbidity of said water over time.

8. The method of claim 4, wherein:

said third characteristic is a measurement of the degree of variability of said turbidity of said water over time.

9. The method of claim 5, wherein:

said fourth characteristic is a measurement of the rate of change of the degree of variability of said turbidity of said water over time.

10. The method of claim 1, wherein:

said first characteristic of said turbidity comprises one of a group consisting of: the turbidity of said water, a rate of change of said turbidity of said water over time, a degree of variability of said turbidity of said water over time, and a rate of change of said degree of variability of said turbidity of said water over time.

11. The method of claim 1, wherein:

said container is disposed within a dishwasher and said object is a dish.

12. The method of claim 1, wherein:

the steps of said method are performed in the order shown in claim 1.

13. A method for washing an object, comprising:

providing a container;

disposing said object within said container;

starting a first washing cycle by providing an initial quantity of water within said container, said cycle being the period from fill to near complete drain of said water in said container;

causing said water to contact the surface of said object;

periodically measuring the turbidity of said initial quantity of water while said water is being caused to contact said surface of said object to provide a series of turbidity measurements over time;

calculating a first magnitude of a first turbidity characteristic from said turbidity measurements of said initial water quantity;

calculating a first magnitude of a second turbidity characteristic from said turbidity measurements of said initial water quantity;

removing a first portion of said initial quantity of said water from said container to obtain a remaining portion, said first portion being less than said initial quantity;

measuring the turbidity of said remaining portion;

calculating a second magnitude of said first turbidity characteristic from said turbidity measurement of said remaining portion;

calculating a second magnitude of said second characteristic of said turbidity of said remaining portion;

determining the degree and character of particulates within said water as a function of the difference between said first and second magnitudes of said first characteristic of said turbidity measurements; and adding clean water to said container to compensate for said removed first portion of said initial quantity of said water, said adding step being performed before measuring the turbidity of the remaining portion; and based upon said determination of degree and character, either removing from the container a second portion of the remaining portion, removing from the container all of the remaining portion, or proceeding with the remaining portion contacting the surface of the object.

14. The method of claim 13, further comprising:

calculating a first magnitude of a third characteristic of said turbidity measurements of said initial water quantity; and calculating a second magnitude of said third characteristic of said turbidity measurement from said remaining portion.

15. The method of claim 14, further comprising:

calculating a first magnitude of a fourth characteristic of said turbidity measurements of said initial water quantity; and calculating a second magnitude of said fourth characteristic of said turbidity measurement from said remaining portion.

16. The method of claim 13, wherein:

said first characteristic is the turbidity of said water.

17. The method of claim 13, wherein:

said second characteristic is a rate of change of said turbidity of said water over time.

18. The method of claim 14, wherein:

said third characteristic is a degree of variability of said turbidity of said water over time.

19. The method of claim 15, wherein:

said fourth characteristic is a rate of change of the degree of variability of said turbidity of said water over time.

20. A method for washing an object, comprising:

providing a container;

disposing said object within said container;

starting a first washing cycle by providing an initial quantity of water within said container, said cycle being the period from fill to near complete drain of said water in said container;

causing said water to contact the surface of said object;

periodically measuring the turbidity of said initial quantity of water while said water is being caused to contact said surface of said object to provide a series of turbidity measurements over time;

calculating a first magnitude of a first turbidity characteristic from said turbidity measurements of said initial water quantity;

calculating a first magnitude of a second turbidity characteristic from said turbidity measurements of said initial water quantity;

removing a first portion of said initial quantity of said water from said container to obtain a remaining portion, said first portion being less than said initial quantity;

measuring the turbidity of said remaining portion;

calculating a second magnitude of said first turbidity characteristic from said turbidity measurement of said remaining portion;

calculating a second magnitude of said second characteristic of said turbidity of said remaining portion;

determining the degree and character of particulates within said water as a function of the difference between said first and second magnitudes of said first characteristic of said turbidity measurements; and based upon said determination of degree and character, either removing from the container a second portion of the remaining portion, removing from the container all of the remaining portion, or proceeding with the remaining portion contacting the surface of the object;

calculating a first magnitude of a third characteristic of said turbidity measurements of said initial water quantity;

calculating a second magnitude of said third characteristic of said turbidity measurement from said remaining portion;

calculating a first magnitude of a fourth characteristic of said turbidity measurements of said initial water quantity;

calculating a second magnitude of said fourth characteristic of said turbidity measurement from said remaining portion; wherein said first characteristic is turbidity of said water;

said second characteristic is a rate of change of said turbidity of said water over time;

said third characteristic is a degree of variability of said turbidity of said water over time;

said fourth characteristic is a rate of change of the degree of variability of said turbidity of said water over time; and adding clean water to said container to compensate for said removed first portion of said initial quantity of said water, said adding step being performed before measuring the turbidity of the remaining portion.

* * * * *